US006453632B1

(12) United States Patent
Huang

(10) Patent No.: US 6,453,632 B1
(45) Date of Patent: Sep. 24, 2002

(54) WOODEN FLOOR BOARD

(76) Inventor: Chin-Chih Huang, 8th Floor, 11, Lane 288, Yunung Rd., Tainan City (TW)

( * ) Notice: Subject to any disclaimer, the term of this patent is extended or adjusted under 35 U.S.C. 154(b) by 0 days.

(21) Appl. No.: 09/611,821

(22) Filed: Jul. 7, 2000

Related U.S. Application Data

(63) Continuation-in-part of application No. 09/370,549, filed on Aug. 9, 1999, now abandoned.

(51) Int. Cl.[7] ..... E04F 15/22

(52) U.S. Cl. ..... 52/403.1; 52/586.1; 52/584.1; 52/385

(58) Field of Search ..... 52/403.1, 483.1, 52/586.1, 584.1, 385, 471, 470, 460, 461, 463

(56) References Cited

U.S. PATENT DOCUMENTS 4,461,131 A * 7/1984 Pressell 5,894,700 A * 4/1999 Sweet

* cited by examiner

*Primary Examiner*—Blair M. Johnson

(74) *Attorney, Agent, or Firm*—Alan Kamrath; Rider, Bennett, Egan & Arundel, LLP

(57) ABSTRACT

A wooden floor board includes a board body and a connector. The board body has two lengthwise ditches formed in the bottom surface. In a preferred form, each lengthwise ditch has a cone-shaped section formed in the innermost section. The elongate connector has two lengthwise upright insert members at two opposite lengthwise sides to engage one of the two lengthwise ditches of two neighborin board bodies. The connector is laid under two neighboring board bodies en assembling the wooden floor boards into a complete floor of a room. Any board body of the complete floor may easily be pried up with a tool like a screwdriver if it is broken and has to be replaced with a new one.

20 Claims, 9 Drawing Sheets

WOODEN FLOOR BOARD

This application is a CIP of U.S application Ser. No. 09/370,549, filed Aug. 9, 1999, now abandon.

BACKGROUND OF THE INVENTION

This invention relates to a wooden floor board, particularly to one possible to be assembled easily together with the DIY mode according to a consumer's liking, improving conventional DIY floor boards.

Many people decorate their rooms with conventional DIY floor boards in the way they like to save expenditure. A first known conventional DIY floor board 10 shown in FIGS. 7 and 8 has some tenons 102 and mortises 101 formed respectively in one lengthwise side and the other lengthwise side and one lateral side and the other lateral side for assembling together with the tenons 102 of a floor board engaging the mortises 101 of another floor board. But, when any floor board 10 is broken after a period of use and has to be replaced with a new one 10, the floor boards next to the broken one to the corner all have to be taken off. After a new one is placed instead of the old broken one, all those boards taken off are again placed back together, requiring much time and work.

A second conventional DIY floor board 20 shown in FIGS. 9 and 10 also has tenons 201 and mortises 203 formed respectively in one lengthwise side and the other lengthwise side and one lateral side and the other lateral side, and a wedge-shaped or cuneiform groove 202 is formed in an end of each tenon 201. In the assembling process, the tenons 201 are forcefully pushed in the mortises 203, with the cuneiform grooves 202 forming tightness between the tenons 201 and the mortises 203. But this second conventional DIY floor board has the following disadvantages.

1. If one floor board is broken and is desired to be replaced with a new one, many floor boards next to the broken one to the corner have to be taken off and assembled together, which is inconvenient as the first conventional one.

2. The cuneiform grooves 202 may lose their expanding force after a long period of use as the tenons 201 are constantly pressed in the mortises 203, making it impossible to keep the tenons 201 always tightly engaged in the mortises 203.

3. The portion of the cuneiform grooves 202 of the tenon 201 may be broken or split off after a period of use, losing its original elasticity.

SUMMARY OF THE INVENTION

An objective of the invention is to offer a wooden floor board of DIY mode, which is possible to be replaced easily after being assembled together into a complete floor on the ground of a room.

Another objective of the invention is to offer a wooden floor board of DIY mode, with connectors of the floor board never losing their elasticity from being broken or split.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
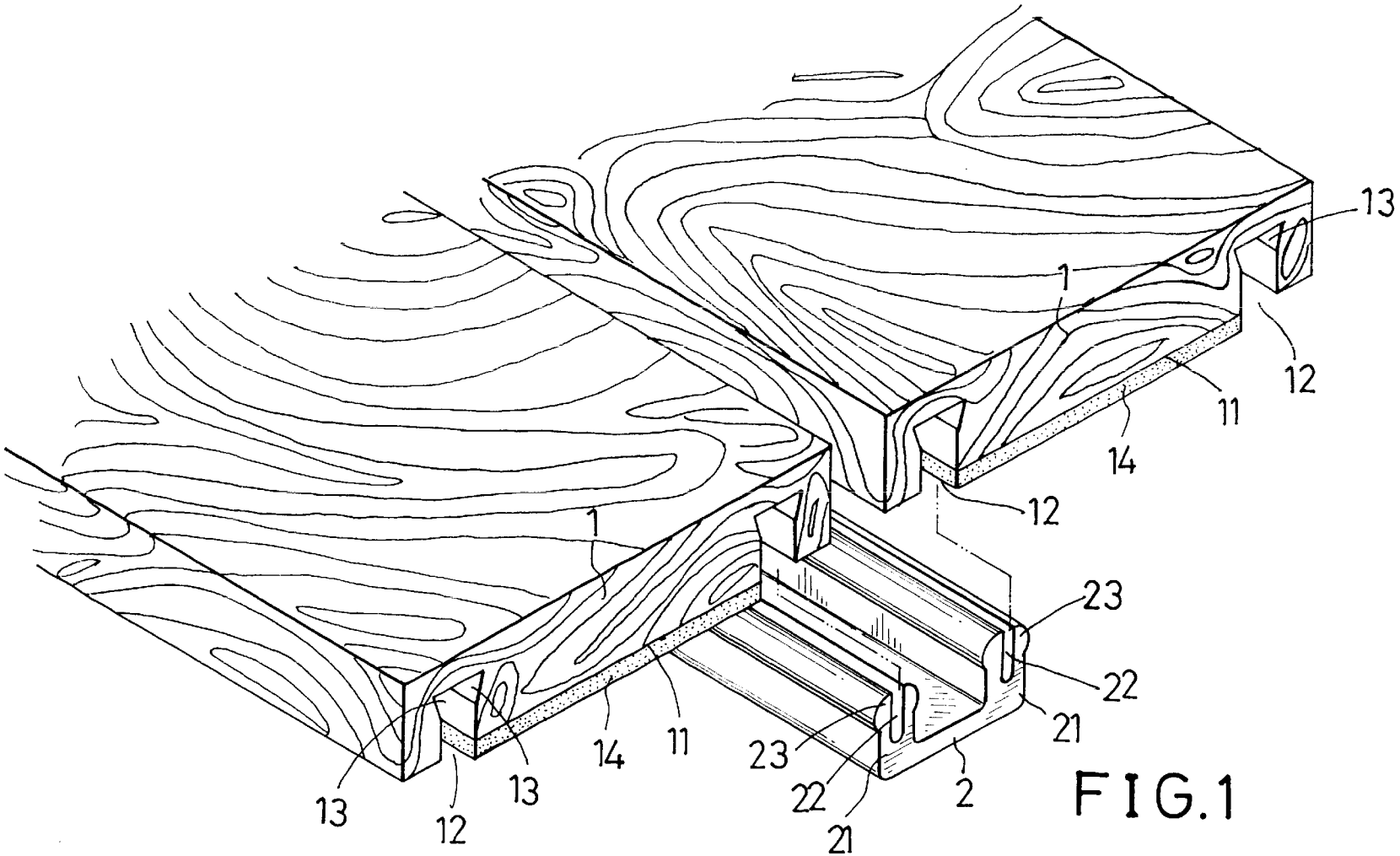
FIG. 1 is an exploded perspective view of a wooden floor board in the present invention.

A first embodiment of a wooden floor board in the present invention, as shown in FIG. 1, includes a board body 1, and a connector 2 combined together.

The board body 1 has a proper length, thickness, and width. Two lengthwise ditches 12 respectively are provided in the two lengthwise sides of the bottom surface 11. Each ditch 12 has a cone-shaped portion in an upper portion. A foam plate 14 is adhered on the bottom surface between the two lengthwise ditches 12.

The connector 2 is U-shaped. Two lengthwise insert members 21 are formed to stand upright on two lengthwise side edges of connector 2. Insert members 21 each have a middle lengthwise groove 22 and a curved-out edge 23 at two sides of groove 22.

Figure 2:
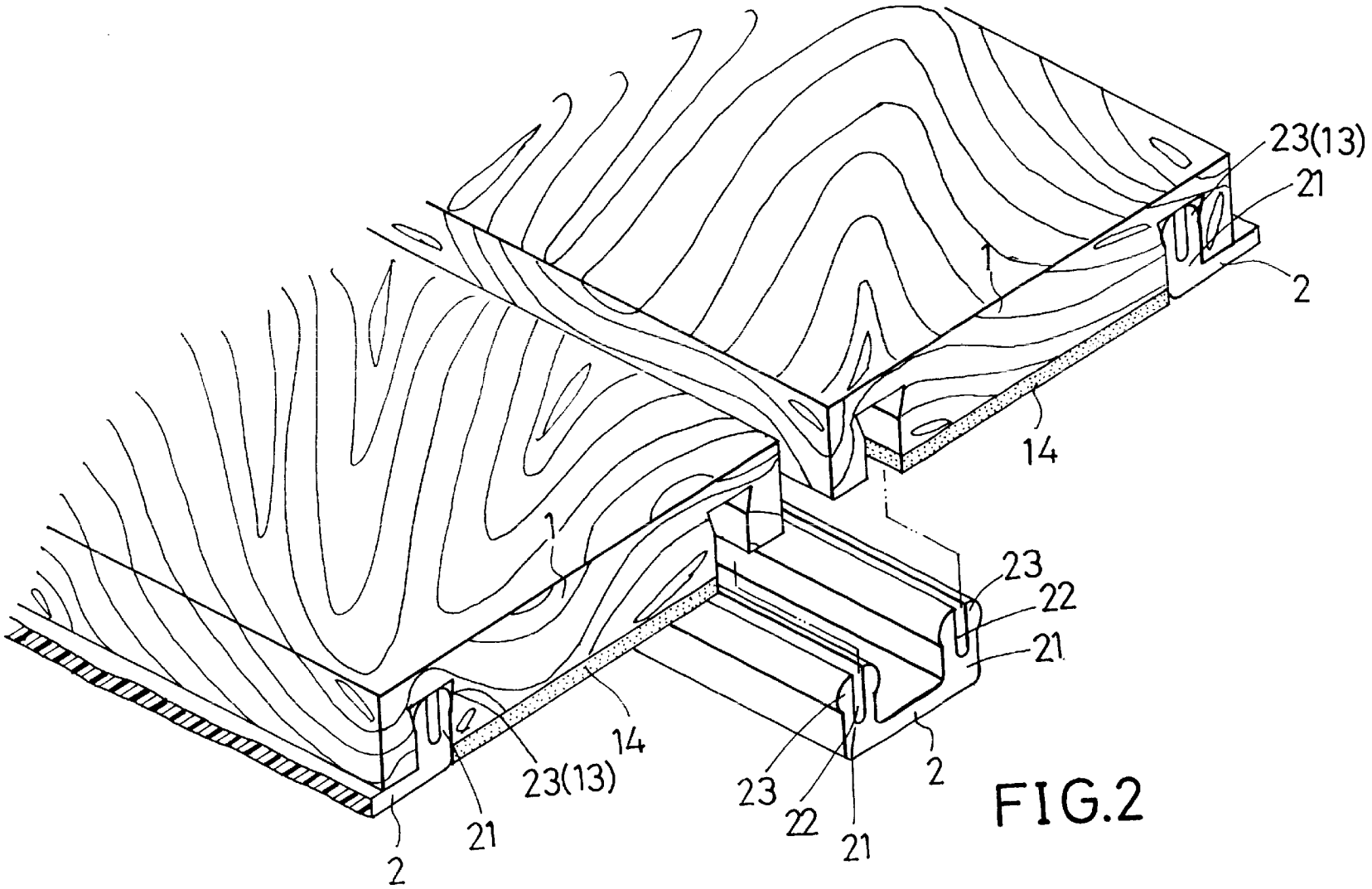
FIG. 2 is a perspective view of the wooden floor boards assembled together in the present invention.
Figure 3:
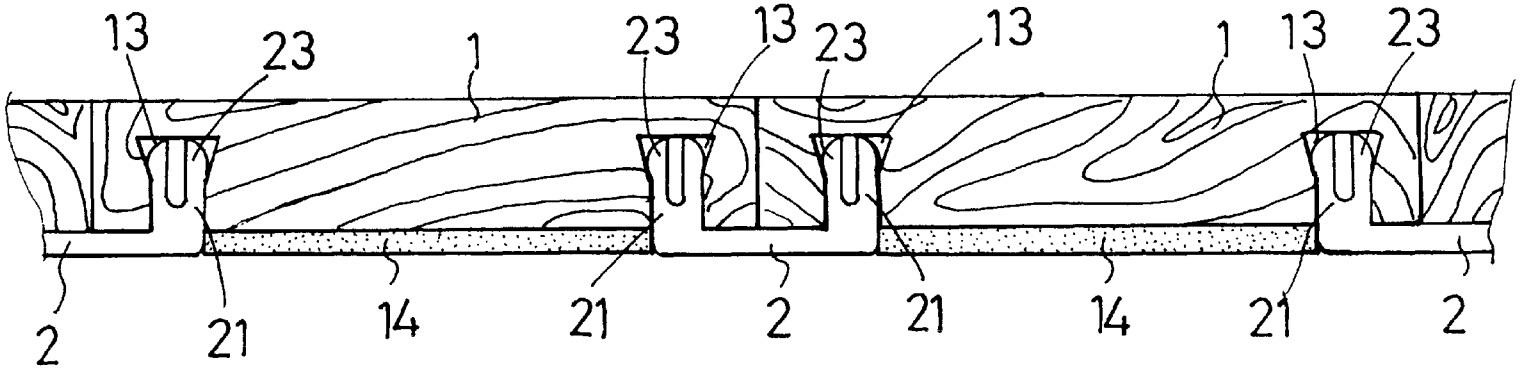
FIG. 3 is a front cross-sectional view of the wooden floor boards assembled together in the present invention.

In assembling the wooden floor boards in the invention on the ground, as shown in FIGS. 2 and 3, the board bodies 1 are laid on the ground with the foam plates 14 contacting the ground 3. Two insert members 21 of one connector 2 fit in one ditch 12 of every two neighboring floor boards. The curved-out edges 23 of the insert members 21 just engage with the cone-shaped sections 13 of the ditches 12. Thus, two neighboring board bodies 1 are finished when assembled together on the ground 3, and the whole floor in a room may be accomplished by repeating these steps.

When any floor board 1 on the floor assembled with those of the invention is broken and has to be replaced with a new one, a person may use a tool such as a screw-driver with a flat blade to pry up and remove the broken floor board 1. Then, a new floor board 1 is pushed down into the space where the old one is laid, with the two ditches 12 fitting with one insert member 21 of two connectors 2. Thus, a large number of the board bodies 1 are not necessary to be taken off and placed back again as is required in the conventional floor boards when replacing one board body 1.

Figure 6:
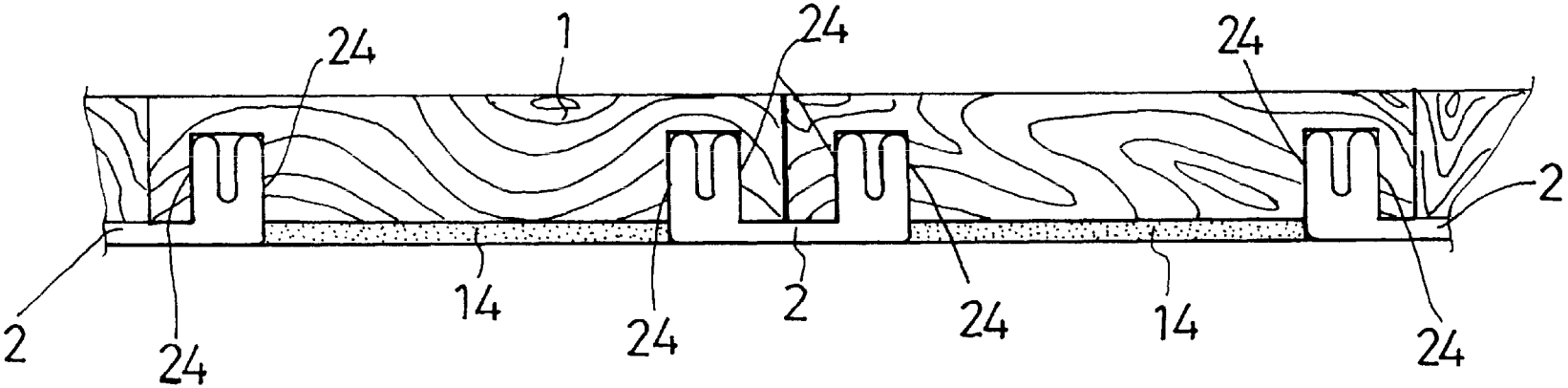
FIG. 6 is a front cross-sectional view of a wooden floor board in the present invention.
Figure 4:
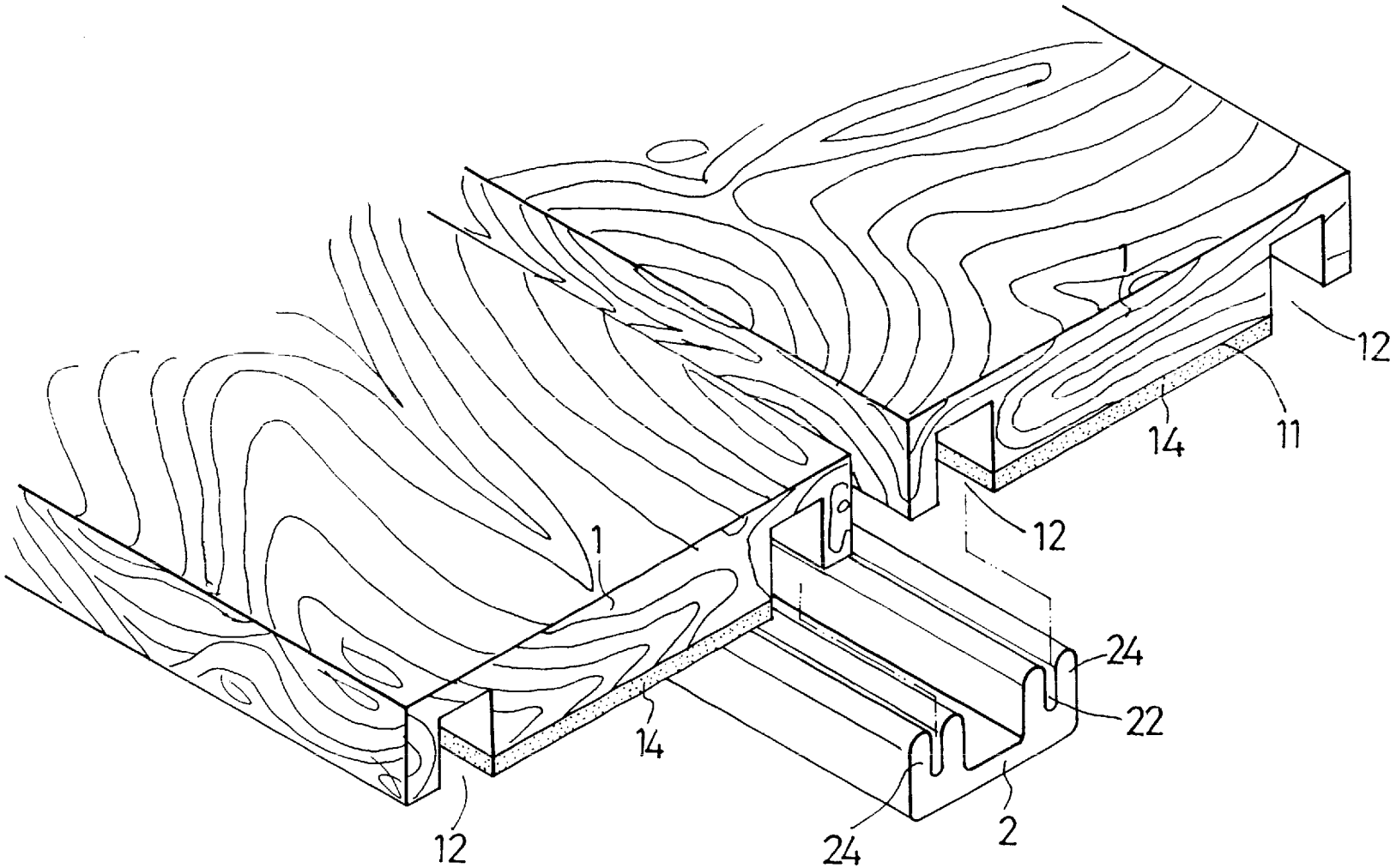
FIG. 4 is an exploded perspective view of a second embodiment of a wooden floor board in the present invention.
Figure 5:
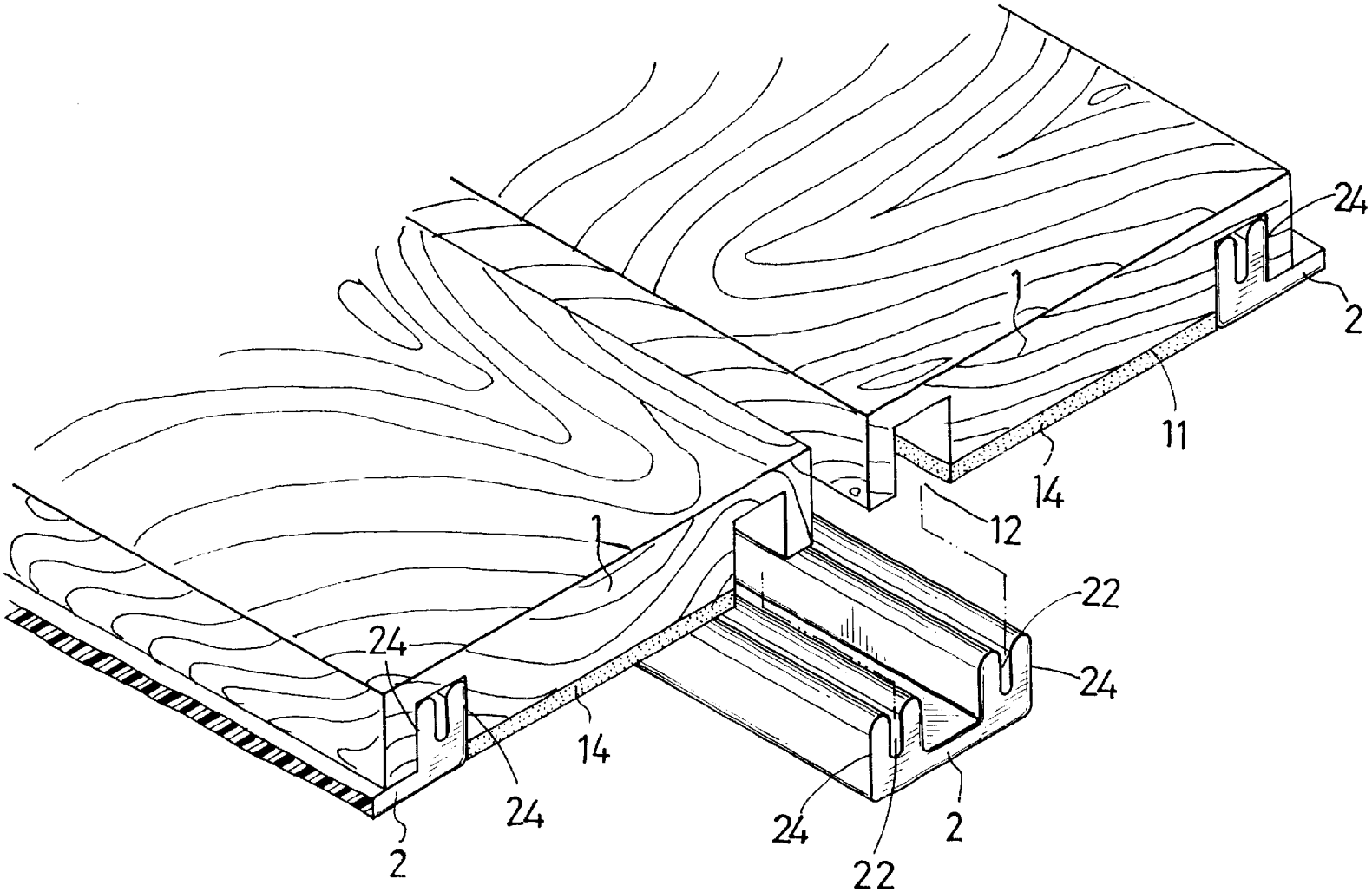
FIG. 5 is a perspective view of the second embodiment of a wooden floor board in the present invention.
Figure 7:
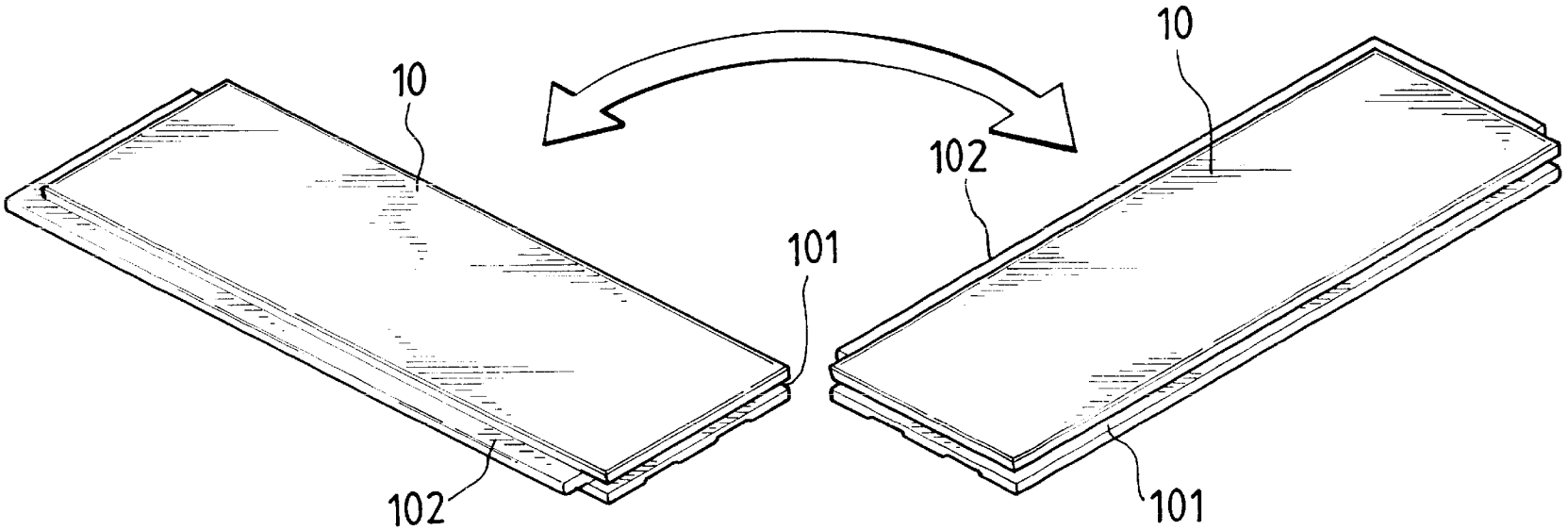
FIG. 7 is a perspective view of a first known conventional wooden floor board.
Figure 8:
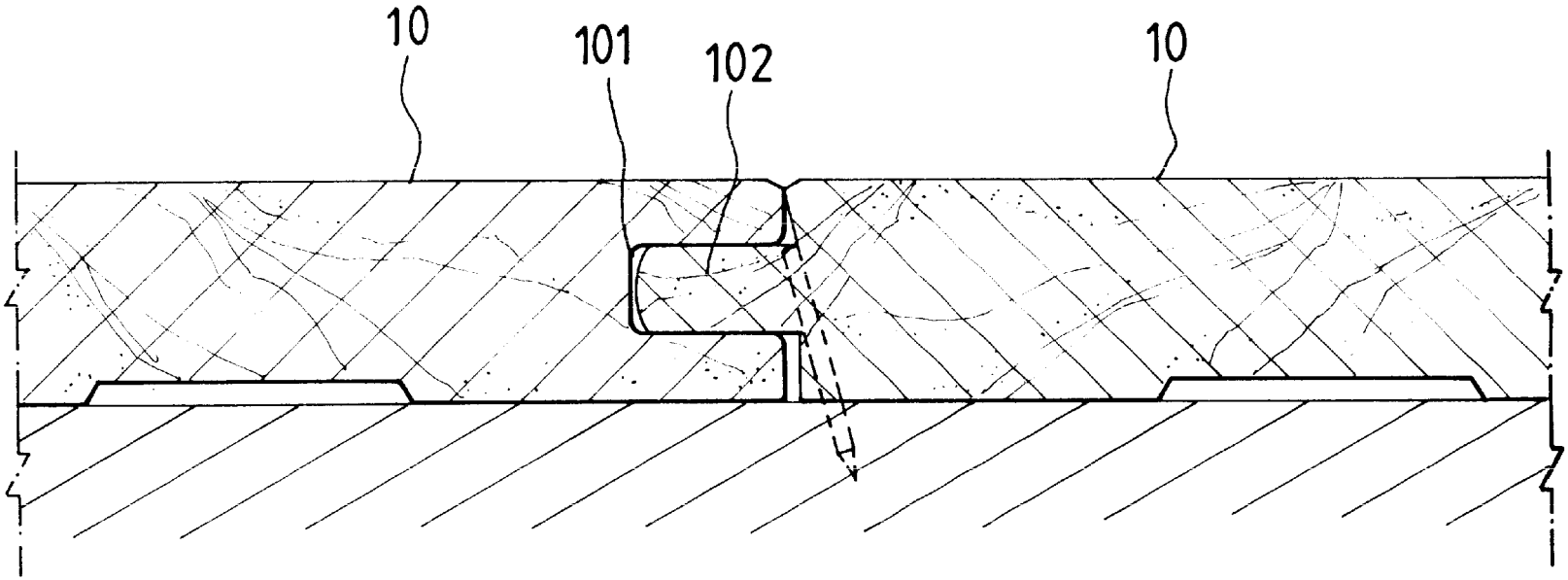
FIG. 8 is a cross-sectional view of the first known conventional wooden floor boards assembled together.
Figure 9:
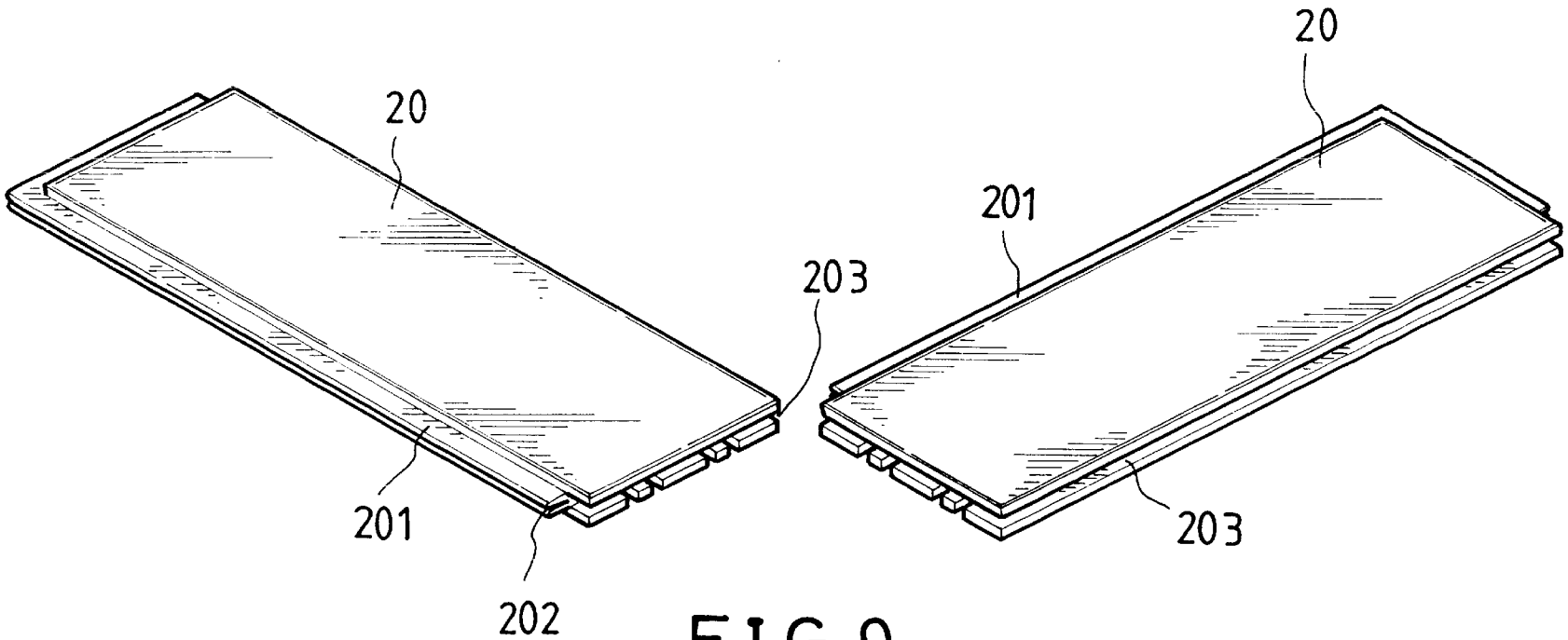
FIG. 9 is a perspective view of a second known conventional wooden floor board; and, FIG. 10 is a cross-sectional view of the second known conventional wooden floor boards assembled together.
Figure 10:
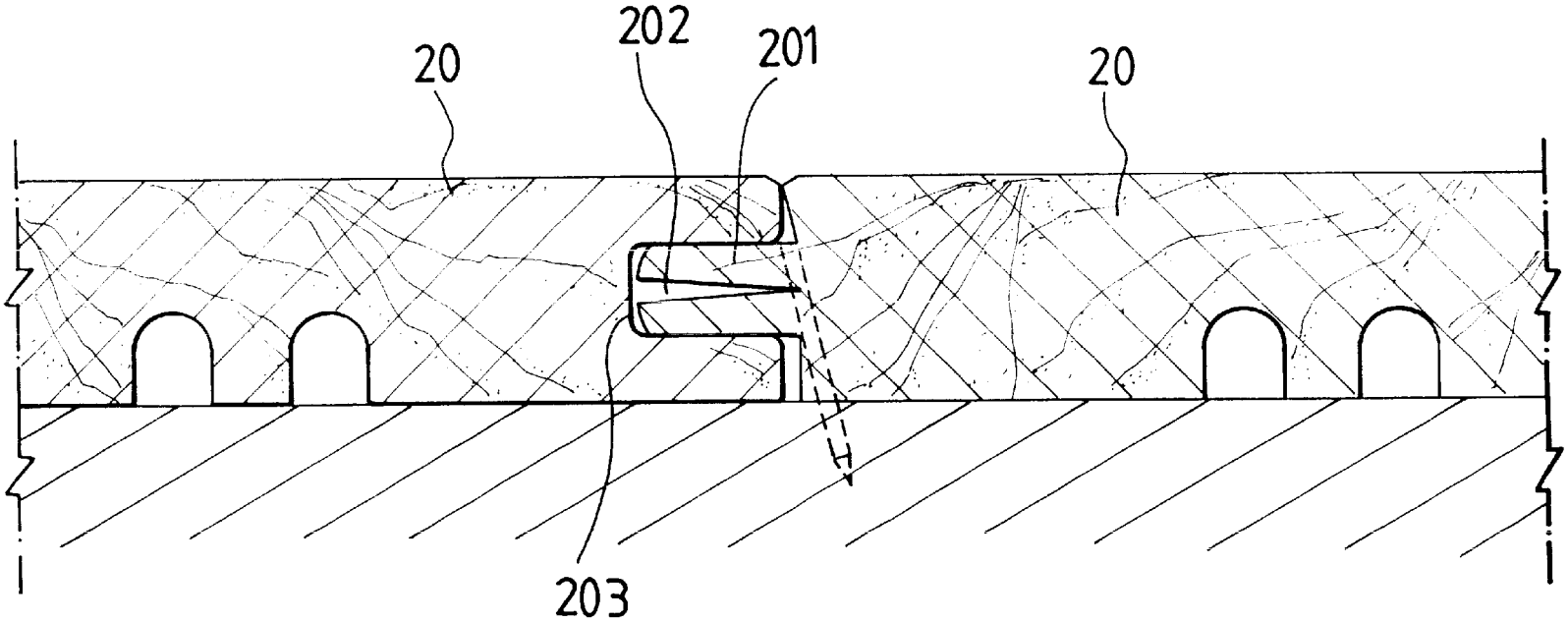

Next, a second embodiment of a wooden floor board, shown in FIGS. 4, 5 and 6, includes a wooden floor board with two lengthwise ditches 12 of a rectangular shape formed in a bottom surface. The two insert members 21 are formed at two lengthwise sides of a connector 2 and have two vertical walls 24 divided with a middle groove. Then, every two neighboring board bodies 1 may be assembled together with one connector 2, with one insert member 21 fitting in one ditch 12 of one board body 1 and with the other insert member fitting in another board body 1. In this way, the whole floor of a room may be laid with the wooden floor boards of the second embodiment with ease even by a lay person.

Further, if any board body 1 is broken and has to be replaced, the same method used in replacing that of the first embodiment can be used.

The wooden floor board in the invention has the following advantages, as can be understood from the aforesaid description.

1. Any wooden floor board in a finished floor may be replaced with a new one, separately, without need of taking off any other ones, and very conveniently.

2. The wooden floor boards are connected with one another by means of the connectors laid under them, so they can be kept intact without damage if they are to be taken off the floor after they are assembled together.

3. The wooden floor boards are easy to manufacture in mass production, lowering their cost so as to be very competitive in their marketing for makers.

While the preferred embodiments of the invention have been described above, it will be recognized and understood that various modifications may be made therein and the appended claims are intended to cover all such modifications which may fall within the spirit and scope of the invention.

What is claimed is:

1. A wooden floor board comprising, in combination:

a board body of a length, width and thickness, with the board body having first and second lengthwise ditches respectively near two lengthwise side edges in a surface, wherein each said lengthwise ditch of said board body has a rectangular shape with two vertical sides; and an elongate U-shaped connector having two upright lengthwise insert members formed at two lengthwise opposite sides, wherein said upright lengthwise insert members of said connector have also a rectangular shape with two vertical sides to engage said lengthwise ditch, with one of said lengthwise insert members engaging said first lengthwise ditch of said board body and with the other of said lengthwise insert members adapted to engage a lengthwise ditch of another board body.

2. The wooden floor board as claimed in claim 1 with each said upright lengthwise insert member having a middle groove in the rectangular shape.

3. The wooden floor board as claimed in claim 2 further comprising, in combination:

a layer of a foam plate attached on said surface between said first and second lengthwise ditches, with the two upright lengthwise insert members extending from a base, with the base abutting with the board body between the lengthwise ditch and the respective lengthwise side edge when the upright lengthwise insert member is received in the lengthwise ditch of the board body, with the thickness of the board body and the layer of the foam plate being equal to the thickness of the board body and the base.

4. The wooden floor board as claimed in claim 3 with the surface to which the layer of foam plate is attached being a bottom surface, with the connector being laid under the board body.

5. A floor board comprising, in combination:

a board body of a length, width and thickness, with the board body having first and second lengthwise ditches respectively near first and second lengthwise side edges in a bottom surface;

a layer of a foam plate attached on said bottom surface between said first and second lengthwise ditches; and an elongate U-shaped connector having first and second upright lengthwise insert members formed at two lengthwise opposite sides of a base, said connector laid under said board body with said first upright lengthwise insert member engaging said first lengthwise ditch of said board body and with second upright lengthwise insert member adapted to engage a lengthwise ditch of another board body with the base abutting the bottom surface of the board body between the first lengthwise ditch and the first lengthwise side edge when the first upright lengthwise insert member is received in the first lengthwise ditch, with the thickness of the board body and the layer of the foam plate being equal to the thickness of the board body and the base.

6. The floor board as claimed in claim 5 wherein each of the first and second lengthwise ditches of the board body has two vertical sides and each of the first and second upright lengthwise insert members of said connector have two vertical sides to engage with the two vertical sides of the respective lengthwise ditch.

7. The floor board as claimed in claim 6 with the first and second upright lengthwise insert members each including a middle groove extending from a free end of the upright lengthwise insert member towards the base and located intermediate and parallel to the two vertical sides of the upright lengthwise insert member.

8. The floor board as claimed in claim 7 with thicknesses of the layer of the foam plate and of the base being equal.

9. The floor board as claimed in claim 8 with the board body having a top surface opposite to the bottom surface, with the top surface intersecting the first and second lengthwise side edges at right angle corners.

10. The floor board as claimed in claim 9 with the board body being one piece formed entirely of wood.

11. The floor board as claimed in claim 5 wherein each of the first and second lengthwise ditches has a cone-shaped section in an innermost portion, with the first and second lengthwise ditches having first and second, vertical planar sides extending from the bottom surface and parallel to and spaced from each other, third and fourth, planar sides extending at equal nonparallel angles outward from the first and second planar sides, and a fifth planar top extending between the third and fourth planar sides, with the third and fourth planar sides extending from the fifth planar top at equal, nonparallel angles, with the third and fourth planar sides and the fifth planar top forming the cone-shaped section.

12. The floor board as claimed in claim 11 with each of the upright lengthwise insert members including a free end, first and second vertical planar sides extending from the base and parallel to and spaced from each other, third and fourth curved-out edges extending between the first and second vertical planar sides and the free end, with the third and fourth curved-out edges curving outwardly from the first and second vertical planar sides and from the free end, with the third and fourth curved-out edges just fitting in the cone-shaped sections of the first and second lengthwise ditches.

13. The floor board as claimed in claim 12 with the first and second upright lengthwise insert members each including a middle groove extending from the free end of the upright lengthwise insert member towards the base and located intermediate and parallel to the first and second vertical planar sides of the upright lengthwise insert member.

14. The floor board as claimed in claim 5 with each of the upright lengthwise insert members including a free end, first and second vertical planar sides extending from the base and parallel to and spaced from each other, third and fourth curved-out edges extending between the first and second vertical planar sides and the free end, with the third and fourth curved-out edges curving outwardly from the first and second vertical planar sides and from the free end.

15. The floor board as claimed in claim 14 with the first and second upright lengthwise insert members each including a middle groove extending from the free end of the upright lengthwise insert member towards the base and located intermediate and parallel to the first and second vertical planar sides of the upright lengthwise insert member.

16. The floor board as claimed in claim 5 with the first and second upright lengthwise insert members each including a middle groove extending from a free end of the upright lengthwise insert member towards the base, with the upright lengthwise insert members being formed of noncompressible material.

17. The floor board as claimed in claim 5 with thicknesses of the layer of the foam plate and of the base being equal.

18. The floor board as claimed in claim 5 with the board body having a top surface opposite to the bottom surface, with the top surface intersecting the first and second lengthwise side edges at right angle corners.

19. The floor board as claimed in claim 5 with the board body being one piece formed entirely of wood.

20. A floor board comprising, in combination:

a board body of a length, width and thickness, with the board body having first and second lengthwise ditches respectively near two lengthwise side edges in a surface, wherein each of the first and second lengthwise ditches has a cone-shaped section in an innermost portion, with the first and second lengthwise ditches having first and second vertical planar sides extending from the bottom surface and parallel to and spaced from each other, third and fourth, planar sides extending at equal nonparallel angles outward from the first and second planar sides, and a fifth planar top extending between the third and fourth planar sides, with the third and fourth planar sides extending from the fifth planar top at equal, nonparallel angles, with the third and fourth planar sides and the fifth planar top forming the cone-shaped section; and an elongate U-shaped connector having first and second upright lengthwise insert members formed at two lengthwise opposite sides of a base, with said first lengthwise insert member engaging said first lengthwise ditch of said board body and with second lengthwise insert member adapted to engage a lengthwise ditch of another board body, with each of the upright lengthwise insert members including a free end, first and second vertical planar sides extending from the base and parallel to and spaced from each other, third and fourth curved-out edges extending between the first and second vertical planar sides and the free end, with the third and fourth curved-out edges curving outwardly from the first and second vertical planar sides and from the free end, with the third and fourth curved-out edges just fitting in the cone-shaped sections of the first and second lengthwise ditches, with the first and second upright lengthwise insert members each including a middle groove extending from the free end of the upright lengthwise insert member towards the base and located intermediate and parallel to the first and second, vertical planar sides of the upright lengthwise insert member.

* * * * *